US009511780B2

(12) United States Patent
Tai et al.

(10) Patent No.: US 9,511,780 B2
(45) Date of Patent: Dec. 6, 2016

(54) ELECTRICAL ENCLOSURE FOR LOCOMOTIVE

(71) Applicant: Electro-Motive Diesel, Inc., Lagrange, IL (US)

(72) Inventors: Steven Tai, Chicago, IL (US); Elizabeth Grace Seban, Evergreen Park, IL (US)

(73) Assignee: Electro-Motive Diesel, Inc., La Grange, IL (US)

( * ) Notice: Subject to any disclaimer, the term of this patent is extended or adjusted under 35 U.S.C. 154(b) by 562 days.

(21) Appl. No.: 13/860,218

(22) Filed: Apr. 10, 2013

(65) Prior Publication Data

US 2014/0305333 A1 Oct. 16, 2014

(51) Int. Cl.
*B61C 17/00* (2006.01)
*B61C 17/04* (2006.01)

(52) U.S. Cl.
CPC ..... *B61C 17/04* (2013.01)

(58) Field of Classification Search
CPC ..... B61C 17/04
See application file for complete search history.

(56) References Cited

U.S. PATENT DOCUMENTS 2,655,092 A * 10/1953 Spooner ..... B60H 1/00464 165/127
2,738,171 A * 3/1956 Walton ..... B60S 1/02 165/100
3,855,450 A * 12/1974 O'Connor ..... B61C 17/04 165/127
4,949,218 A * 8/1990 Blanchard ..... H05K 7/206 165/104.33
6,378,442 B1 * 4/2002 Gebhard ..... B61C 17/00 104/288
6,480,672 B1 * 11/2002 Rosenzweig ..... F24H 3/0417 392/365
8,072,752 B2 * 12/2011 Wantschik ..... H02B 1/565 312/223.1
9,229,498 B2 * 1/2016 Chen ..... G06F 1/20
2008/0257624 A1 * 10/2008 Kubo ..... B60K 1/04 180/68.1
2013/0248264 A1 * 9/2013 Matsuda ..... B60K 1/04 180/65.22
2014/0020968 A1 * 1/2014 Ikeya ..... B60K 1/04 180/65.31
2014/0305333 A1 * 10/2014 Tai ..... B61C 17/04 105/26.05
2015/0059613 A1 * 3/2015 Matsumoto ..... B61D 17/00 105/396

FOREIGN PATENT DOCUMENTS

CN 202320320 U * 7/2012
CN 202320320 U 11/2012

* cited by examiner

*Primary Examiner* — Jason C Smith
(74) *Attorney, Agent, or Firm* — Finnegan, Henderson, Farabow, Garrett & Dunner, LLP

(57) ABSTRACT

An electrical enclosure is disclosed for use with a mobile machine having a cabin. The electric enclosure may have a plurality of compartments configured to house a plurality of different electrical components. The electrical enclosure may also have a duct formed within a first of the plurality of compartments located below a floor of the cabin. The duct may be configured to receive conditioned air from the cabin and to direct the conditioned air from a second of the plurality of compartments into the first of the plurality of compartments.

18 Claims, 3 Drawing Sheets

ELECTRICAL ENCLOSURE FOR LOCOMOTIVE

TECHNICAL FIELD

The present disclosure relates generally to an electrical enclosure and, more particularly, to an electrical enclosure for a locomotive.

BACKGROUND

Locomotives include various electrical components used to control different aspects of consist operation. These components can include light switches, temperature regulators, sensors, breakers, displays, and processing equipment, among others. Locomotive operators and service technicians are required to frequently access the electrical components in order to operate, service, inspect and/or repair the components. As such, it can be important for the electrical components to be conventionally located near a cab of the locomotive.

Historically, the electrical components of a locomotive were housed within a compartment that abuts the cab of the locomotive. In this location, however, access to the components was difficult on some locomotives. In addition, the environment (e.g., the temperature and/or vibration) of the locomotive compartments can be extreme, causing the components to fail prematurely.

One example of a container configured to house electrical components is described in U.S. Pat. No. 6,378,442 that issued to Gebhard on Apr. 30, 2002 ("the '442 patent"). In particular, the '442 patent discloses a container having a base frame mounted to the roof of a car body. A plurality of electrical components (including a fan) are mounted within the container. In this configuration, the electrical components are located close to an operator of the car, and the fan can be used to cool the remaining components.

Although the container of the '442 patent may effectively house some electrical components, it may still be less than optimal. In particular, the connection between the container and the roof of a car body may provide opportunities for noise and vibration to enter the car body and the container. In addition, the fan, alone, may be insufficient in some environments to adequately cool the remaining electrical components.

The electrical enclosure of the present disclosure solves one or more of the problems set forth above and/or other problems in the art.

SUMMARY

In one aspect, the present disclosure is directed to an electrical enclosure for use with a mobile machine having a cabin. The electrical enclosure may include a plurality of compartments configured to house a plurality of different electrical components. The electrical enclosure may also include a duct formed within a first of the plurality of compartments located below a floor of the cabin. The duct may be configured to receive conditioned air from the cabin and to direct the conditioned air from a second of the plurality of compartments into the first of the plurality of compartments.

In another aspect, the present disclosure is directed to a cabin for a mobile machine. The cabin may include a floor, a ceiling, a front wall connecting the floor to the ceiling, a left side wall connecting the floor to the ceiling, and a right side wall connecting the floor to the ceiling. The cabin may also include an electrical enclosure forming a back wall that connects the floor to the ceiling and the left side wall to the right side wall. The electrical enclosure may have at least a first compartment located below the floor and at least a second compartment located above the floor.

DETAILED DESCRIPTION

Figure 1:
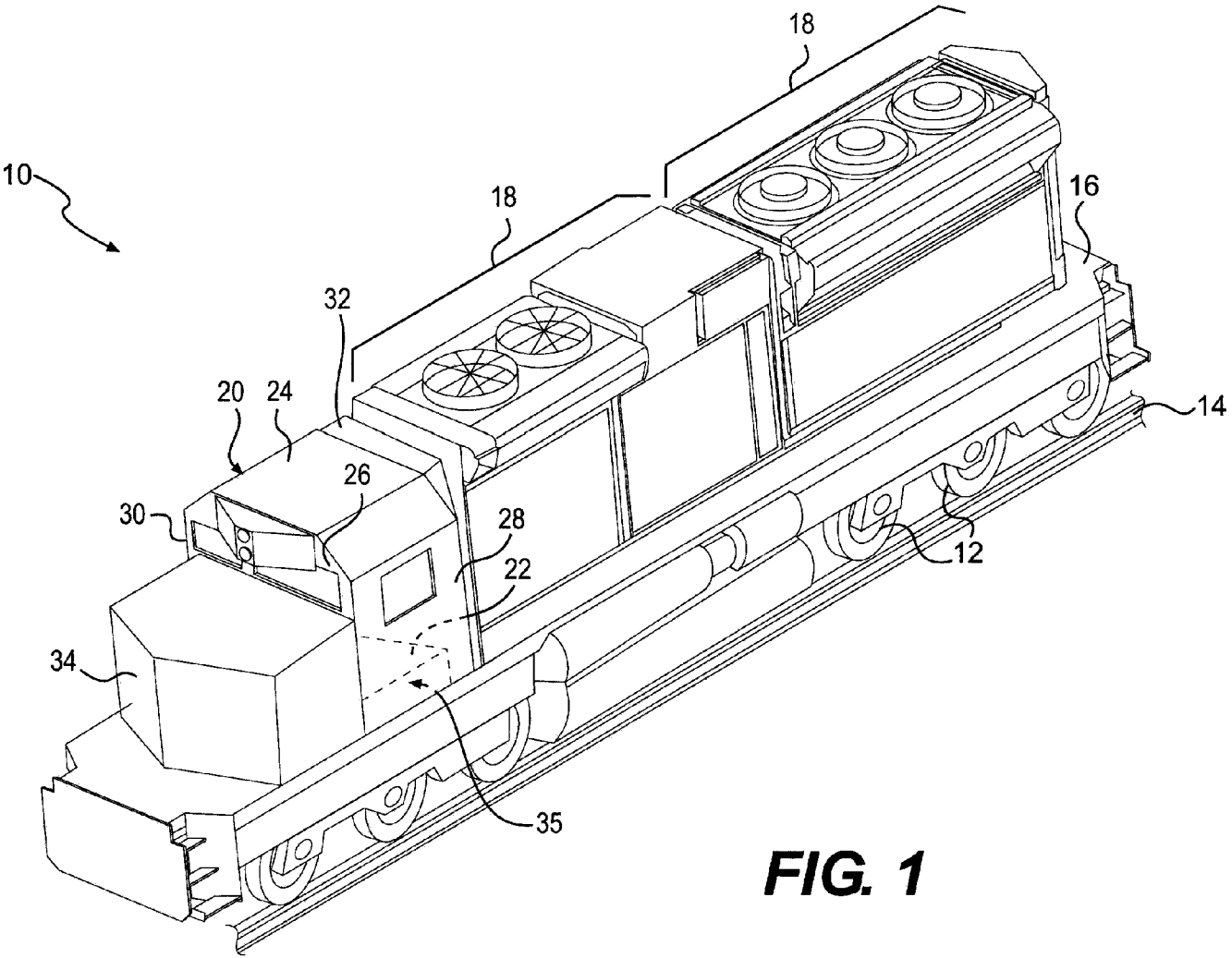
FIG. 1 is a pictorial illustration of an exemplary disclosed locomotive.

FIG. 1 illustrates a locomotive 10 having a plurality of wheels 12 configured to engage a track 14. A base platform 16 may be supported by wheels 12, and one or more power modules 18 may be mounted to base platform 16 and configured to drive wheels 12. An operator cabin ("cab") 20 may provide an interface for control of power modules 18 and also be mounted to base platform 16, forward of power module(s) 18.

Any number of power modules 18 may be included within locomotive 10 and operated to produce power that can be transferred to one or more traction motors (not shown) used to drive wheels 12. Power modules 18 may include a generator (not shown), and an engine (not shown) that is mechanically coupled to the generator. The generator may be, for example, an DC induction generator, a permanent-magnet generator, an DC synchronous generator, or a switched-reluctance generator that is driven by the engine to produce electrical power. The engine may be an internal combustion engine such as a diesel engine, a gasoline engine, or a gaseous-fuel powered engine that combusts a mixture of fuel and air to generate a mechanical input to the generator. Alternatively, the engine may be a fuel cell engine.

The generator, engine, traction motors, and other components and systems of locomotive 10 (e.g., brakes, HVAC, lighting, navigation, communication, etc.) may each have associated control devices used by the operator of locomotive 10. These control devices may be co-located within cab 20, and cab 20 may therewith provide a control environment for the operator of locomotive 10.

Figure 2:
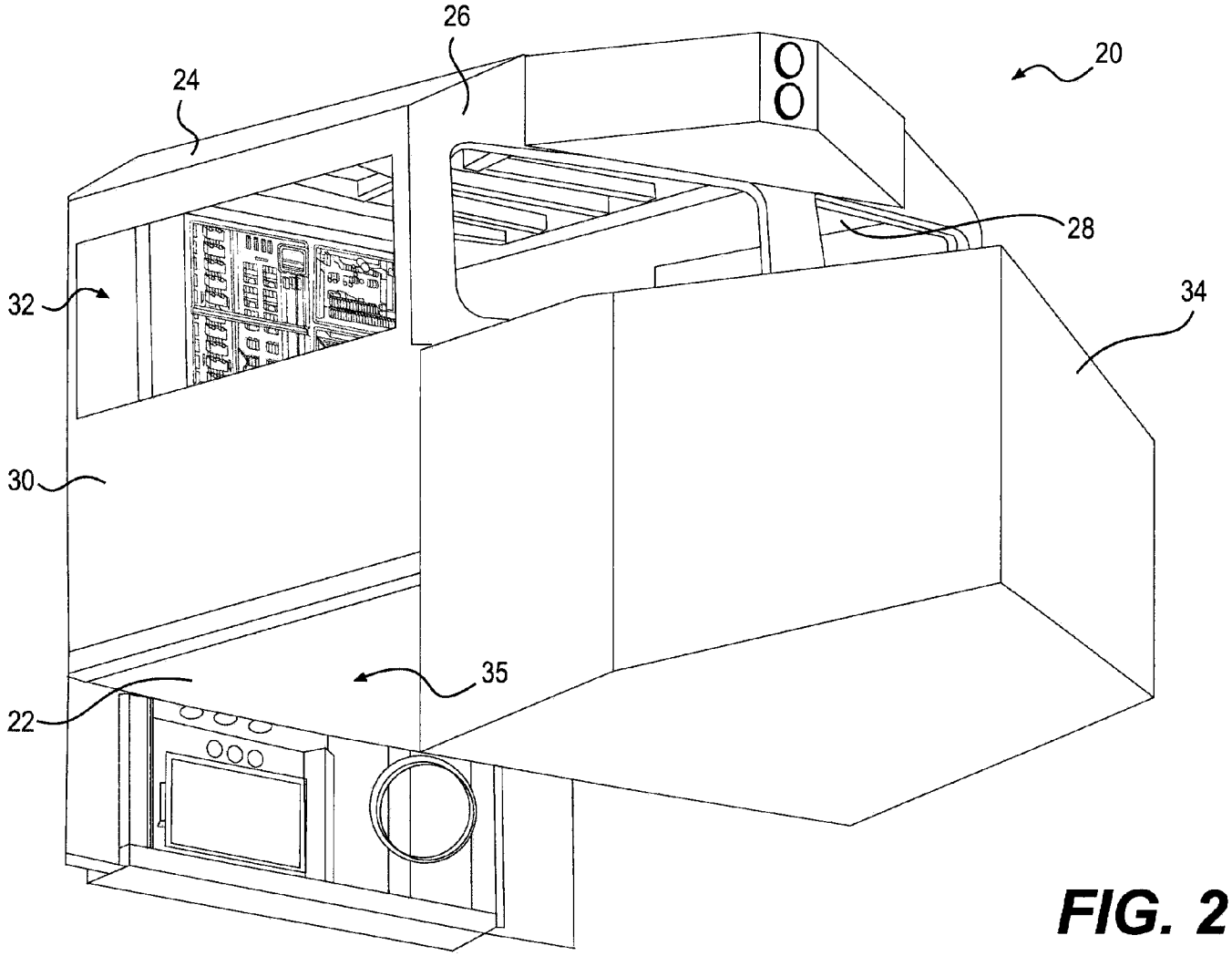
FIG. 2 is a pictorial illustration of an exemplary disclosed operator cabin that may be used in conjunction with the locomotive of FIG. 1.

As shown in FIGS. 1 and 2, cab 20 may include a floor 22, a roof 24, a front wall 26, a left side wall 28, a right side wall 30, and an electrical enclosure 32 that functions as a rear wall (i.e., no other rear wall is used in the disclosed embodiment to close off the back end of cab 20). Together, floor 22, roof 24, front wall 26, left side wall 28, right side wall 30, and electrical enclosure 32 may form a generally enclosed space for housing the control devices discussed above. Each of these structural components may be connected together in any way known in the art. In the disclosed embodiment, these components are rigidly connected to each other by way of welding. Specifically, floor 22, roof 24, front wall 26, left side wall 28, right side wall 30, and electrical enclosure ("enclosure") 32 may be welded together at their intersections prior to cab 20 being hoisted into place and connected to platform 16. Cab 20 may be removably connected to platform 16 by way of isolation mounts (not shown) and threaded fastening (not shown). In this manner, cab 20 may be somewhat isolated from vibrations induced within platform 16 by operation of power module 18. It is contemplated that cab 20 may alternatively be rigidly connected to platform 16, if desired.

As also shown in FIG. 2, a portion of enclosure 32 may extend past (i.e., below) floor 22. For example, about one-third to one-fourth of the overall height of enclosure 32 may extend past floor 22 and rest upon platform 16. In this configuration, the back end of cab 20 may be raised above platform 16 and supported by enclosure 32. Similarly, the front end of cab 20 may be raised away from platform 16 and supported by a nose module 34. In some embodiments, nose module 34 houses restroom facilities and/or crash protection equipment. The raised arrangement of cab 20 may create a space 35 beneath floor 22 of cab 20 (i.e., between floor 22 of cab 20 and platform 16), which may be used to house, among other things, heating-air/conditioning-and-ventilation (HVAC) equipment (not shown). As will be described in more detail below, a lower portion 36 of enclosure 32 (i.e., the portion extending past floor 22) may function as ductwork to fluidly communicate the HVAC equipment with the interior of cab 20.

Figure 3:
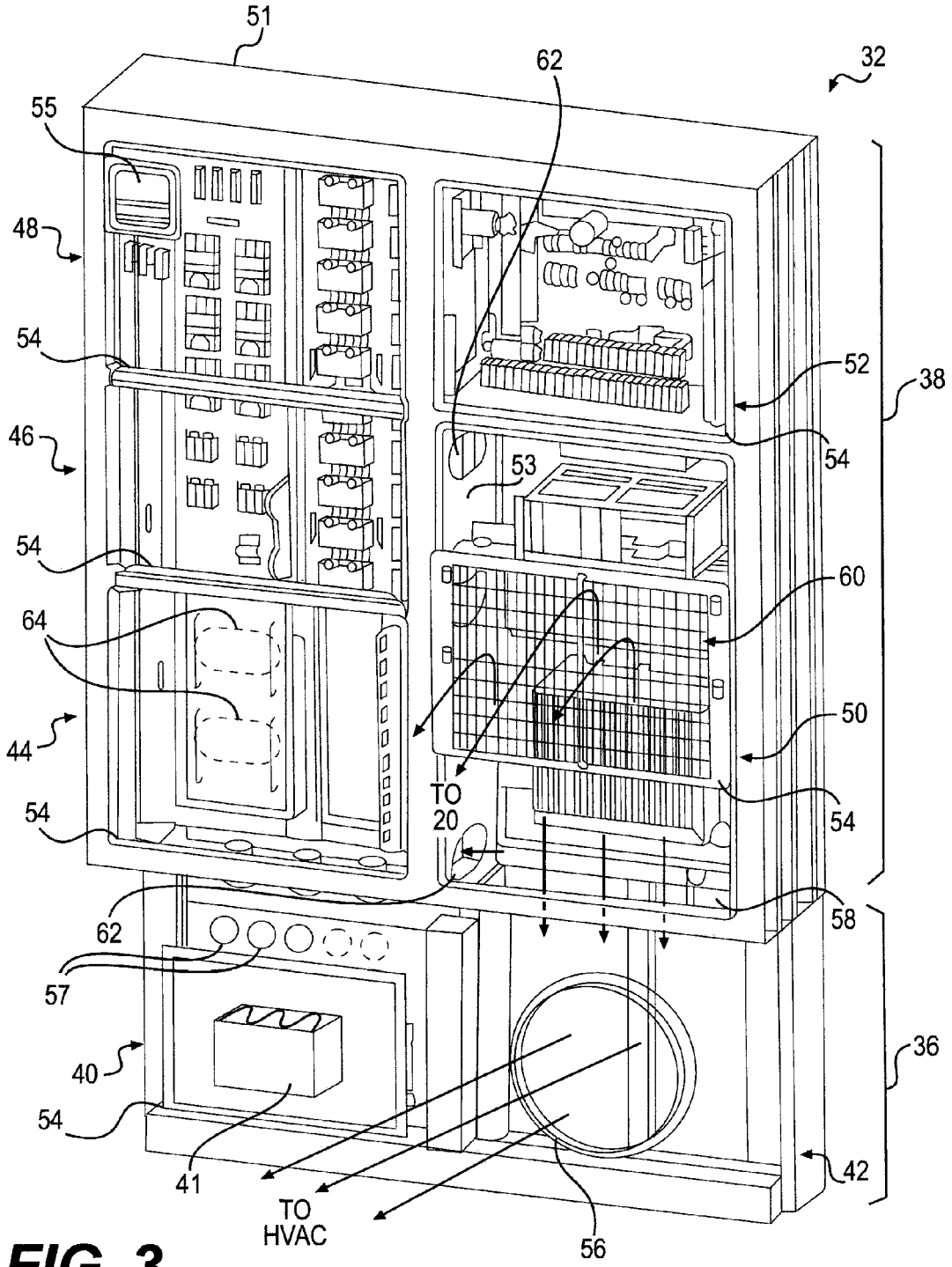
FIG. 3 is a pictorial illustration of an exemplary disclosed electrical enclosure that may be used in conjunction with the operator cabin of FIG. 2.

As shown in FIG. 3, enclosure 32 may include lower portion 36 and an upper portion 38 that at least partially cantilevers past a forward face of lower portion 36. In the disclosed embodiment, upper portion 38 has a depth that is about two times a depth of lower portion 36 (i.e., upper portion 38 cantilevers past the forward face of lower portion 36 by an amount about equal to a depth of lower portion 36). In this arrangement, a lower surface of upper portion 38 may be at about the same level as (e.g., rest on or abut) floor 22 of cab 20.

Each of lower and upper portions 36, 38 may be divided into one or more different compartments. For example, lower portion 36 may be divided into horizontally-adjacent first and second compartments 40, 42, while upper portion 38 may be divided into first and second columns of vertically stacked compartments. The first column of compartments may include third, fourth, and fifth vertically-stacked compartments 44, 46, 48, while the second column of compartments may include sixth and seventh vertically stacked compartments 50, 52. The two columns of compartments may be separated by a vertical divider 53. The seventh compartment 52 may be generally larger than the remaining compartments (e.g., about twice as large), which are all about the same size. It should be noted, however, that compartments 40-52 may have any desired size. Some or all of compartments 40-52 may be equipped with a pivoting door 54, which provides operator access to equipment stored within the corresponding compartment. In some embodiments, one or more interface devices 55 (e.g., dials, gauges, readouts, switches, levers, buttons, etc.) may be formed within or otherwise connected to an exterior of doors 54, such that the operator of locomotive 10 may interface with the components of enclosure 32 without opening door 54.

Compartment 40, being arranged within lower portion 36, may contain components that require little or less frequent access. That is, because of its location below floor 22 of cab 20, access may primarily be obtained when locomotive 10 is stationary. These components may include, for example, a resistor grid 41. In some embodiments, compartment 40 may be provided with one or more vents 57 that facilitate the dissipation of heat to the environment from resistor grid 41. For example, multiple vents 57 may be located within door 54 and/or within an opposing rear wall 51 of enclosure 32. This may allow for circulating ambient air to cool resistor grid 41, without the heat from resistor grid 41 negatively affecting the remaining components housed within enclosure 32.

Compartment 42 may serve primarily as duct work for the HVAC system. In particular, compartment 42 may include an opening 56 (e.g., a generally circular opening) configured to connect with the HVAC system located below floor 22 of cab 20, and direct a flow of conditioned air to or from the HVAC System. As is known in the art, this flow of air may include heated air during cool environmental conditions, and cooled air during warmer environmental conditions. Ideally, cab 20 is kept at a relatively constant temperature and humidity throughout operation, for example at about 70° F. and about 25-35% humidity via the HVAC system and/or fresh air from outside cab 20. The flow of air received via door 54 may be directed downward through compartment 42 to opening 56. In the disclosed embodiment, passage 58 may be generally rectangular, and extend across the entire cross-sectional area of compartment 42. It is contemplated, however, that passage 58 may have any other appropriate shape and size.

One or more filters 60 may be disposed on door 54 of compartment 50. Filters 60 may be configured to clean the flow of air before it passes into compartment 50. In this way, dust and debris that could negatively affect the components within compartment 50 may be avoided. Filters 60, in the disclosed embodiment, may have a larger cross-sectional area than compartment 42, so as to reduce a restriction placed on the air flow by filters 60. In order to accommodate the larger filters 60, filters 60 may be placed at an angle (e.g., at about 45°) relative to the flow direction.

The components located within compartment 50 (i.e., the components located within the direct flow path of conditioned air) may be the components most critical to temperature extremes and/or significant changes in temperature. These components may include, for example, signal conditioners (e.g., filters, amplifiers, etc.), electrical power supplies, communication equipment, and electrical control boards (e.g., alternators, converters, CPUs, memory, processors, and inverters). Each of the components may be directly connected to a wall of enclosure 32 or, alternatively, connected to a shelf, a bracket, a panel, or another mounting feature that is itself connected to a wall of enclosure 32. Because of their location within the flow path of conditioned air, the temperatures and humidity of the components within compartment 50 may remain relatively stable. In addition, access to these components for purposes of service or control may be provided via cab 20.

The flow of conditioned air may be directed from the enclosed space of cab 20 into enclosure 32 to cool or heat the components therein. In particular, door 54 of compartment 50 may be perforated or otherwise include vents allowing the flow of air to exit the closed space of cab 20 and enter enclosure 32. In this manner, enclosure 32 may function as the ductwork connecting the HVAC system located below floor 22 with the interior of cab 20. Alternatively or additionally, the flow of conditioned air may be reversed. In this manner, the flow of conditioned air, after passing through compartment 50 and cooling (or heating) the components therein, may be used to condition cab 20. In particular, door 54 of compartment 50 may be perforated or otherwise include vents allowing the flow of air to exit enclosure 32 and enter the enclosed space of cab 20.

Compartments 44-48, in some situations, may be fluidly connected to compartment 50 via one or more openings 62 located within vertical divider 53. In this manner, the temperatures and/or humidity of compartments 44-48 may be controlled somewhat, although to a lesser degree than compartment 50 due to the indirect and smaller associated flow paths. Accordingly, the components housed within compartments 44-48 may be less sensitive to varying temperatures and/or humidity than components housed within compartment 52. The components housed within compartments 44-48 may include, for example, multiplex connectors, power distribution connectors, circuit modules, relays, TDP (Thermal Dissipation Profile) boards, etc. It is contemplated that openings 62 may additionally or alternatively be utilized for electrical connection between components in adjacent compartments. Similarly, one or more openings 64 may pass through rear wall 51 of enclosure 32, providing a conduit for electrical wires that run between components of enclosure 32 and power modules 18.

Compartment 52 may be located above compartment 50 and adjacent compartment 48. In this location, the components within compartment 52 may be substantially isolated from the conditioned air of compartment 50 and located at about eye-level within cab 20. Accordingly, the components within compartment 52 may be generally less sensitive than the remaining components of enclosure 32, but accessed more frequently by the operator of locomotive 10. In the disclosed embodiment, a panel of circuit breakers is housed within compartment 52.

Enclosure 32 (including compartments 40-52 and doors 54) may be fabricated from any material through any process known in the art. In the disclosed example, enclosure 32 is fabricated from a ferrous metal, such that enclosure 32 can be welded to the remaining structure of cab 20. In this example, one or more walls of enclosure 32 may be fabricated from sheet stock through a cutting and welding process, a stamping and folding process, or through any other desirable process. For example, all of the walls of enclosure 32 could be stamped from a single sheet of structural steel, folded into place, and then welded along intersecting lines. Alternatively one or more of the walls may be cut separately and then welded together, as desired. Doors 54 may then be connected to the walls of enclosure 32 by way of hinges and/or latches.

INDUSTRIAL APPLICABILITY

Although the disclosed electrical enclosure may be applicable to different types of machines where access to contents of the enclosure during operation is important, the disclosed electrical enclosure finds particular applicability within mobile machines, such as locomotives, that are exposed to elevated levels of noise and vibration during operation. The disclosed electrical enclosure may provide greater cab isolation from noise and vibration generated within an adjacent engine room of the locomotive. Further, more efficient and greater temperature regulation of electrical components may be provided in a low-cost and simple manner, because existing HVAC components and systems may be used for dual purposes (e.g., to both cool cab 20 and the components within enclosure 32). Finally, the disclosed enclosure may help to locate a variety of components in positions most suited to their specific environmental and accessibility requirements.

It will be apparent to those skilled in the art that various modifications and variations can be made to the disclosed electrical enclosure without departing from the scope of the disclosure. Other embodiments of the disclosed electrical enclosure will be apparent to those skilled in the art from consideration of the specification and practice of the electrical enclosure disclosed herein. It is intended that the specification and examples be considered as exemplary only, with a true scope of the disclosure being indicated by the following claims and their equivalents.

What is claimed is:

1. An electrical enclosure for a mobile machine having a cabin, the electrical enclosure comprising:

a plurality of compartments configured to house a plurality of different electrical components; and a duct formed within a first of the plurality of compartments located below a floor of the cabin, the duct configured to receive conditioned air from the cabin and to direct the conditioned air from a second of the plurality of compartments into the first of the plurality of compartments, wherein the second of the plurality of compartments includes a ventilated door configured to allow the flow of conditioned air to exit the cabin and enter the electrical enclosure.

2. The electrical enclosure of claim 1, wherein the duct includes:

an opening formed in a door of the first of the plurality of compartments; and a passage located at the floor of the cabin and connecting the first and second of the plurality of compartments.

3. The electrical enclosure of claim 1, wherein the plurality of different electrical components includes at least one of a signal conditioner, an electric power supply, communication equipment, and a control board located within the second of the plurality of compartments.

4. The electrical enclosure of claim 1, further including a filter disposed within the ventilated door, in a flow path of the conditioned air.

5. The electrical enclosure of claim 1, wherein the filter is disposed at an angle relative to a flow direction of the conditioned air.

6. The electrical enclosure of claim 1, wherein:

the plurality of compartments includes a ventilated third compartment; and the plurality of different electrical components includes a resistor grid mounted within the third compartment that is configured to transfer heat with an ambient atmosphere below the floor of the cabin.

7. The electrical enclosure of claim 6, wherein the third compartment is located adjacent the first of the plurality of compartments.

8. The electrical enclosure of claim 7, wherein:

the plurality of compartments includes a fourth compartment stacked on top of the third compartment and located adjacent the second of the plurality of compartments;

the plurality of different electrical components includes at least one of a multiplex connector, a power distribution connector, a circuit module, a relay, and a TDP board mounted within the fourth compartment; and the fourth compartment is fluidly connected with the second of the plurality of compartments.

9. The electrical enclosure of claim 8, wherein:

the plurality of compartments includes a fifth compartment stacked on top of the second of the plurality of compartments and horizontally adjacent the fourth compartment;

the plurality of different electrical components includes a panel of circuit breakers mounted within the fifth compartment; and the fifth compartment is substantially isolated from the remaining of the plurality of compartments.

10. The electrical enclosure of claim 1, wherein:

the second of the plurality of compartments is about twice as big as each of the remaining of the plurality of compartments; and the remaining of the plurality of compartments are all about the same size.

11. The electrical enclosure of claim 1, wherein:

each of the plurality of compartments includes a door; and the plurality of different electrical components includes an operator interface device mounted within the door.

12. The electrical enclosure of claim 1, further including an opening in a back wall forming a conduit for an electrical wire.

13. A cabin for a mobile machine, comprising:

a floor;

a ceiling;

a front wall connecting the floor to the ceiling;

a left side wall connecting the floor to the ceiling;

a right side wall connecting the floor to the ceiling; and an electrical enclosure forming a back wall that connects the floor to the ceiling and the left side wall to the right side wall, the electrical enclosure having at least a first compartment located below the floor and at least a second compartment located above the floor, wherein the at least a second compartment includes a ventilated door configured to direct conditioned air from the cabin into the at least a second compartment.

14. The cabin of claim 13, wherein the floor, ceiling, front wall, left side wall, right side wall, and electrical enclosure are welded together.

15. The cabin of claim 14, wherein the at least a first compartment forms a duct configured to direct conditioned air from the at least a second compartment to below the floor.

16. The cabin of claim 14, further including a filter disposed within the at least a second compartment.

17. The cabin of claim 14, wherein the electrical enclosure includes a third compartment configured to house a resistor grid and being ventilated to a space below the floor.

18. A locomotive, comprising:

a plurality of wheels configured to engage a track;

a base platform supported by the plurality of wheels;

a power module mounted to the base platform; and a cabin located forward of the power module and having an electrical enclosure that forms a back wall of the cabin and spaces the cabin away from the base platform, wherein the electrical enclosure includes:

a first compartment forming a duct and being configured to receive conditioned air from a space above a floor of the cabin and above the base platform;

a second compartment located above the floor and in fluid communication with the first compartment, the second compartment having a ventilated door in the cabin; and a filter disposed within the first compartment.

* * * * *